US005865375A

United States Patent [19]

Hsu

[11] Patent Number: 5,865,375

[45] Date of Patent: Feb. 2, 1999

[54] SHOWER HEAD DEVICE

[76] Inventor: Min-Hui Hsu, 56, Min Sheng Street, Fengyuan, Taichung Shien, Taiwan, 420

[21] Appl. No.: 921,224

[22] Filed: Aug. 27, 1997

[51] Int. Cl.[6] ..... B05B 15/06

[52] U.S. Cl. ..... 239/282; 239/437; 239/588; 248/206.4; 4/567; 4/615

[58] Field of Search ..... 239/282, 283, 239/436, 437, 558, 588; 248/206.3, 206.4, 363; 4/567, 570, 605, 615, 661

[56] References Cited

U.S. PATENT DOCUMENTS

| | | | |
|---|---|---|---|
| 1,962,793 | 6/1934 | Vogel | 239/282 |
| 1,985,502 | 12/1934 | Isenberg | 239/282 |
| 2,073,307 | 3/1937 | Isenberg | 239/282 |
| 2,893,644 | 7/1959 | Holden | 239/282 |
| 3,677,951 | 7/1972 | Alles | 248/206.4 X |
| 4,951,329 | 8/1990 | Shaw | 4/615 X |
| 5,161,265 | 11/1992 | Mikiya et al. | 238/206.3 X |

*Primary Examiner*—Andres Kashnikow
*Assistant Examiner*—Steven J. Ganey

[57] ABSTRACT

A shower head device has a main body, a threaded portion disposed on a lower end of the main body, a shower face disposed on an upper end of the main body, and a lateral recess formed on a lateral of the main body. A flat plate is adhered on the lateral recess. A plurality of sucking discs are disposed on the flat plate.

1 Claim, 7 Drawing Sheets

SHOWER HEAD DEVICE

BACKGROUND OF THE INVENTION

This invention relates to a shower head device, and more particularly to a shower head device which has a plurality of sucking discs.

A conventional shower head device is often disposed on a fixture which is fixed on a tile of the wall of the bathroom. However, the tile is easily broken while a user drills a hole on the wall of the bathroom. Further, the position of the fixture cannot be adjusted. When the user washes the head, the user may not be able to watch the position of the fixture in order to place the conventional shower head device on the fixture.

SUMMARY OF THE INVENTION

A main object of this invention is to provide a shower head device which can be disposed on any position of the wall of the bathroom stably.

Another object of this invention is to provide a shower head device which can be disposed on the wall of the bathroom without any fixture.

DETAILED DESCRIPTION OF THE INVENTION

Figure 1:
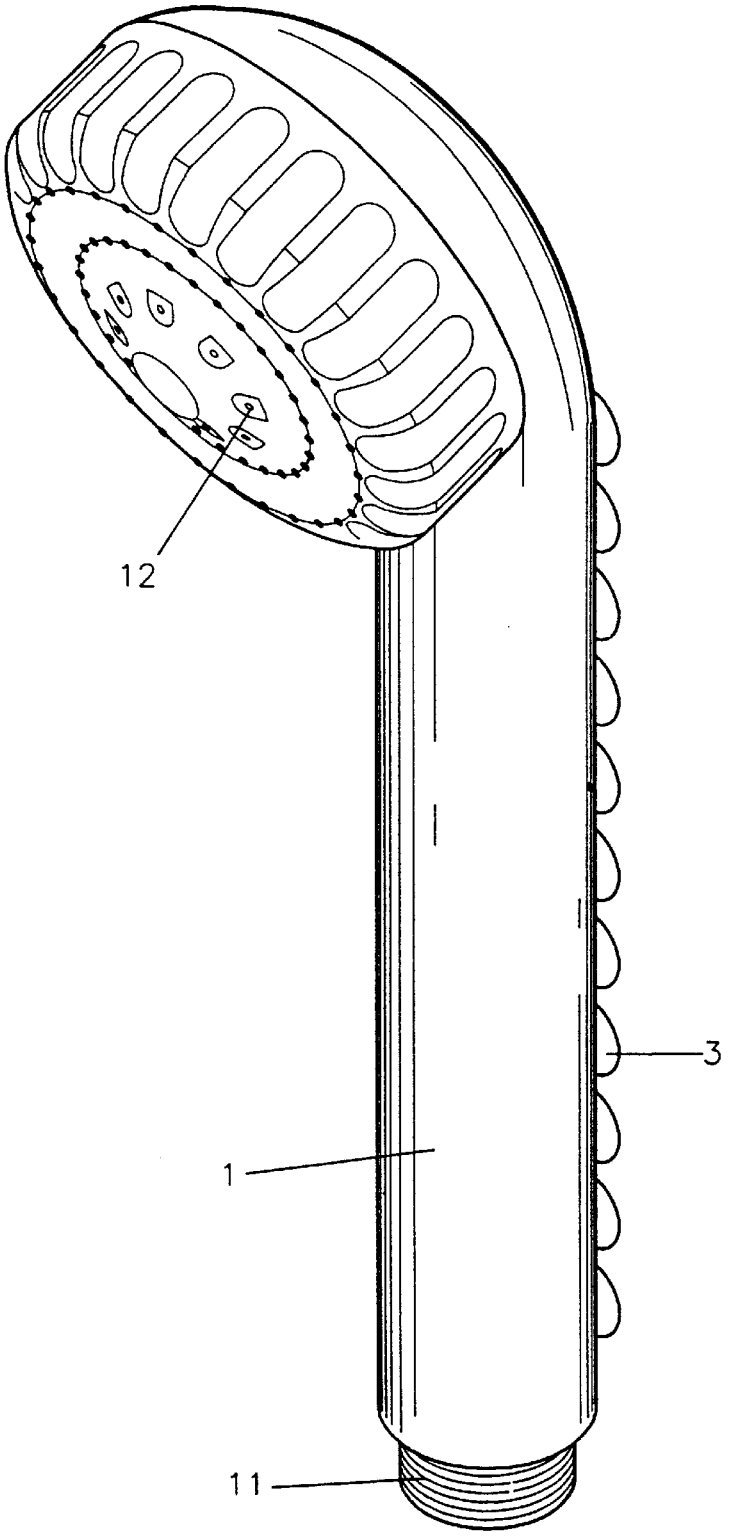
FIG. 1 is a perspective view of a shower head device of a first preferred embodiment.
Figure 2:
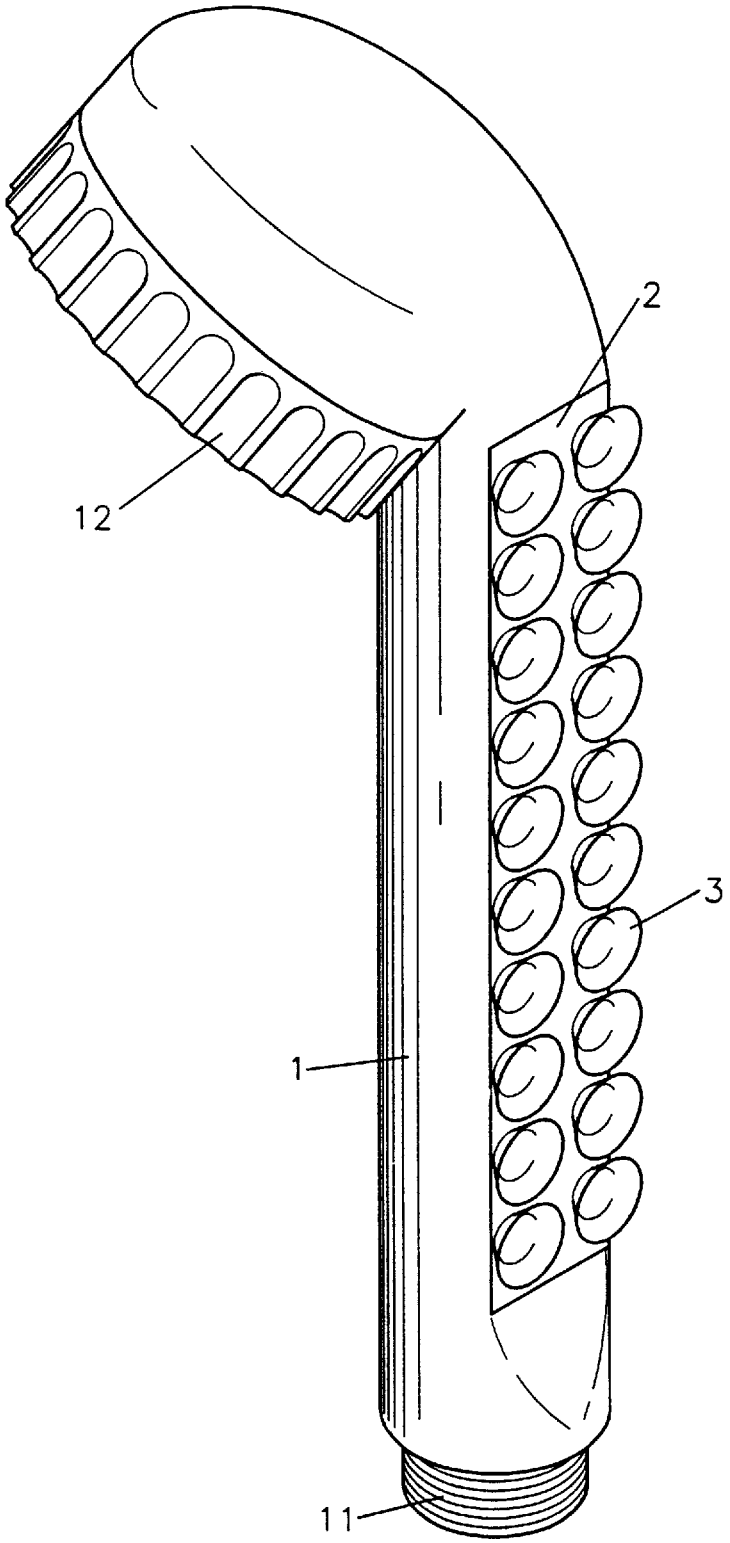
FIG. 2 is another perspective view of a shower head device of a first preferred embodiment.
Figure 3:
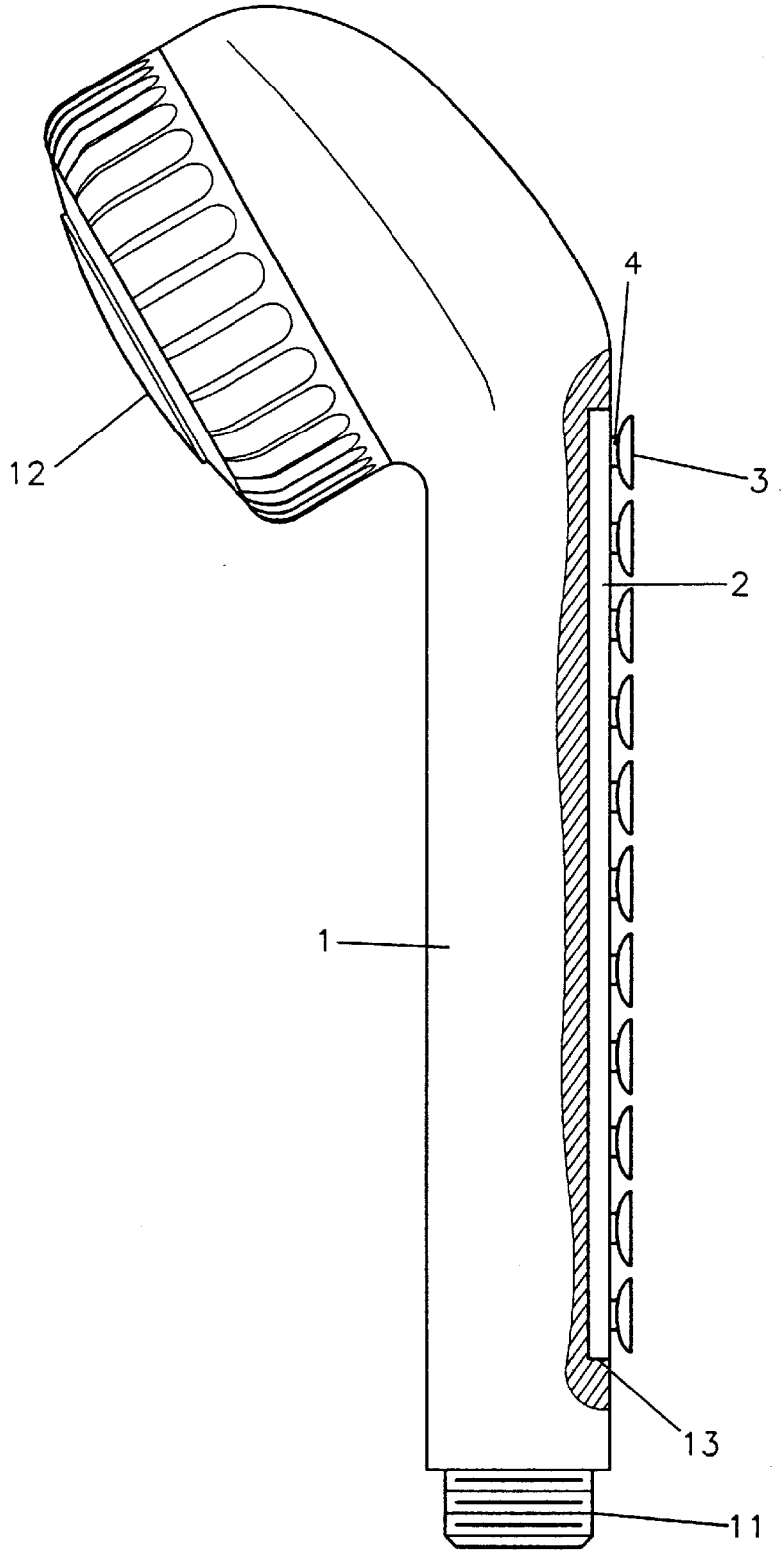
FIG. 3 is a partially sectional view of a shower head device of a first preferred embodiment.

Referring to FIGS. 1 to 3, a first shower head device comprises a main body 1, a threaded portion 11 disposed on a lower end of the main body 1, a shower face 12 disposed on an upper end of the main body 1, and a lateral recess 13 formed on a lateral of the main body 1. A flat plate 2 is adhered on the lateral recess 13. A plurality of sucking discs 3 are disposed on the flat plate 2. The sucking discs 3 are made of soft materials. Each sucking disc 3 has a base 4.

Figure 4:
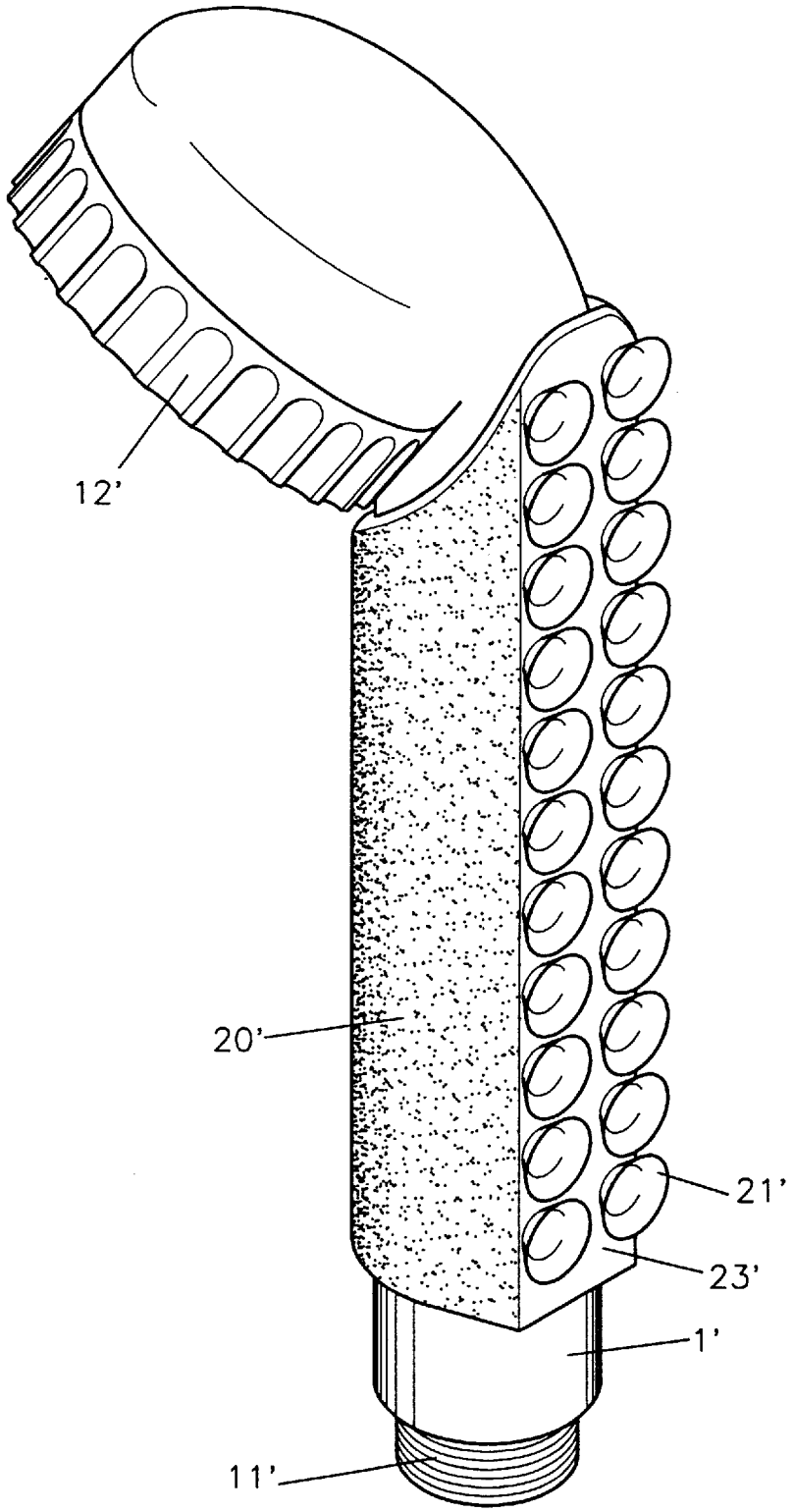
FIG. 4 is a perspective view of a shower head device of a second preferred embodiment.
Figure 5:
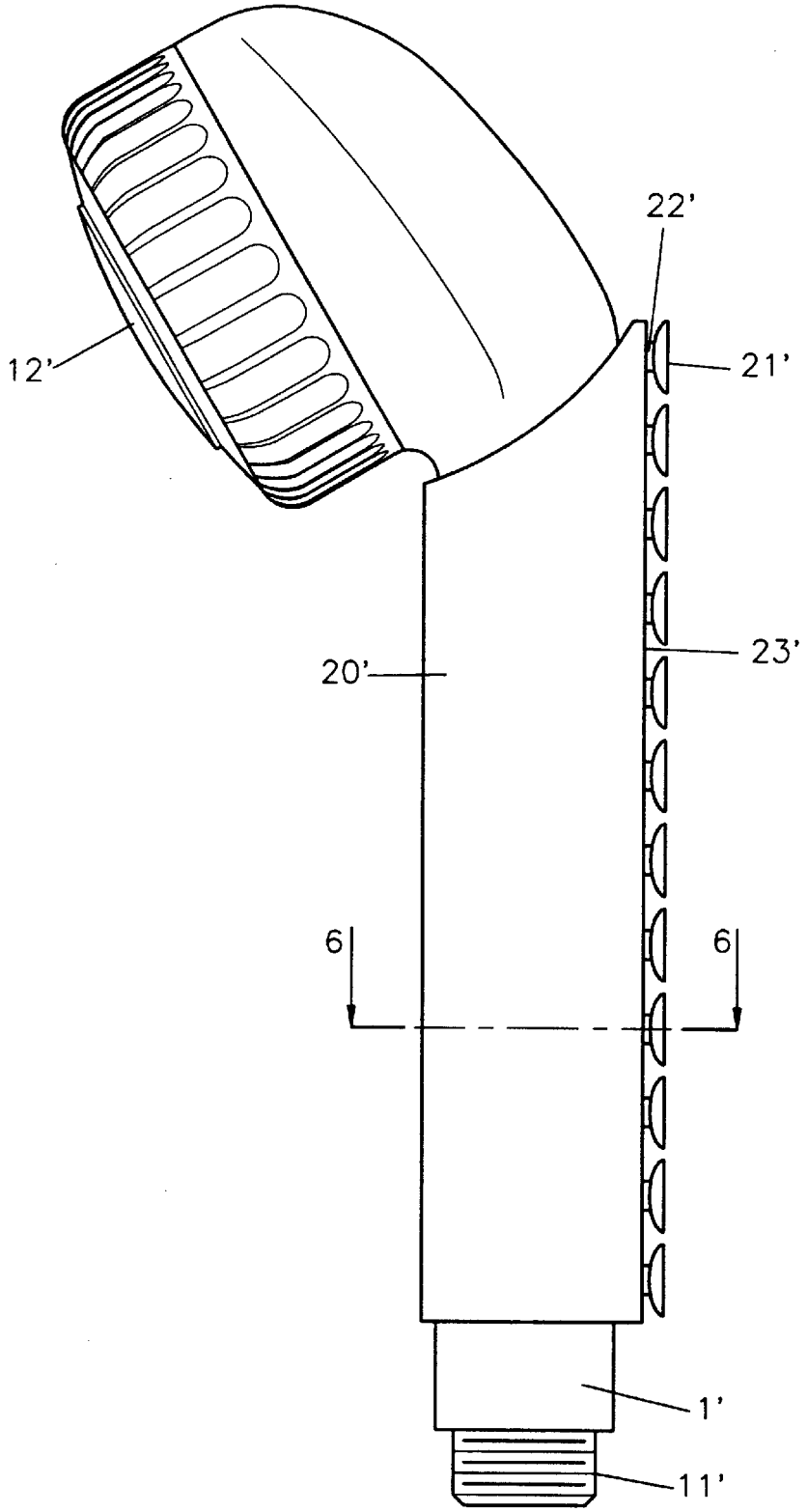
FIG. 5 is an elevational view of a shower head device of a second preferred embodiment.
Figure 6:
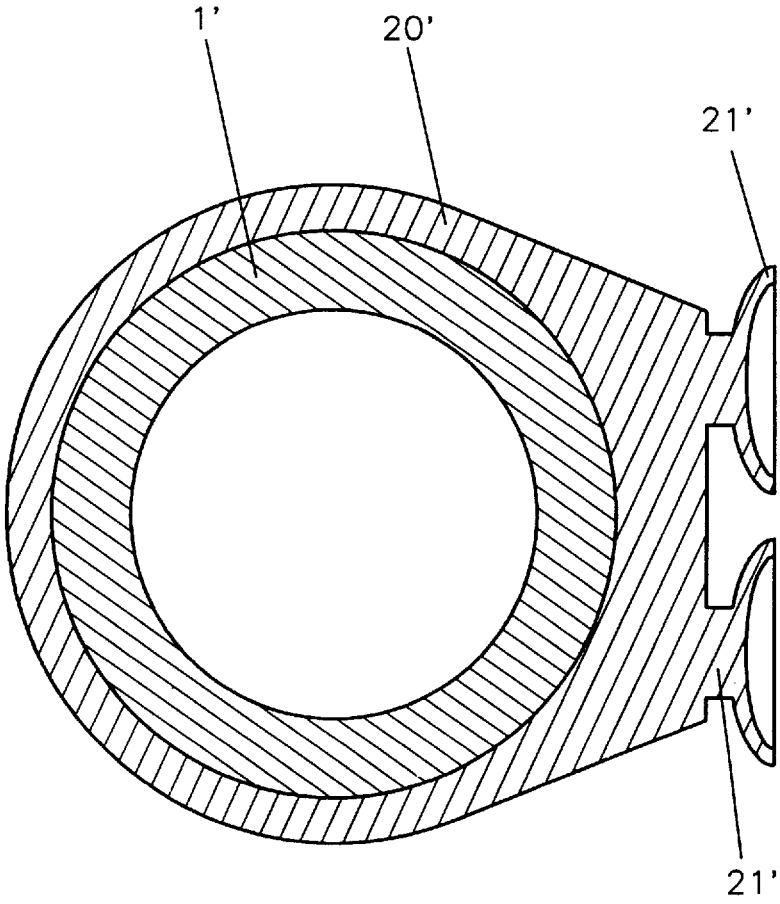
FIG. 6 is a sectional view taken along line 6—6 in FIG. 5.

Referring to FIGS. 4 to 6, a second shower head device comprises a main body 1', a threaded portion 11' disposed on a lower end of the main body 1', a shower face 12' disposed on an upper end of the main body 1', and an outer casing 20' enclosing the main body 1'. A flat lateral 23' is formed on the outer casing 20'. A plurality of sucking discs 21' are disposed on the flat lateral 23'. The sucking discs 21' are made of soft materials. Each sucking disc 21' has a base 22'.

Figure 7:
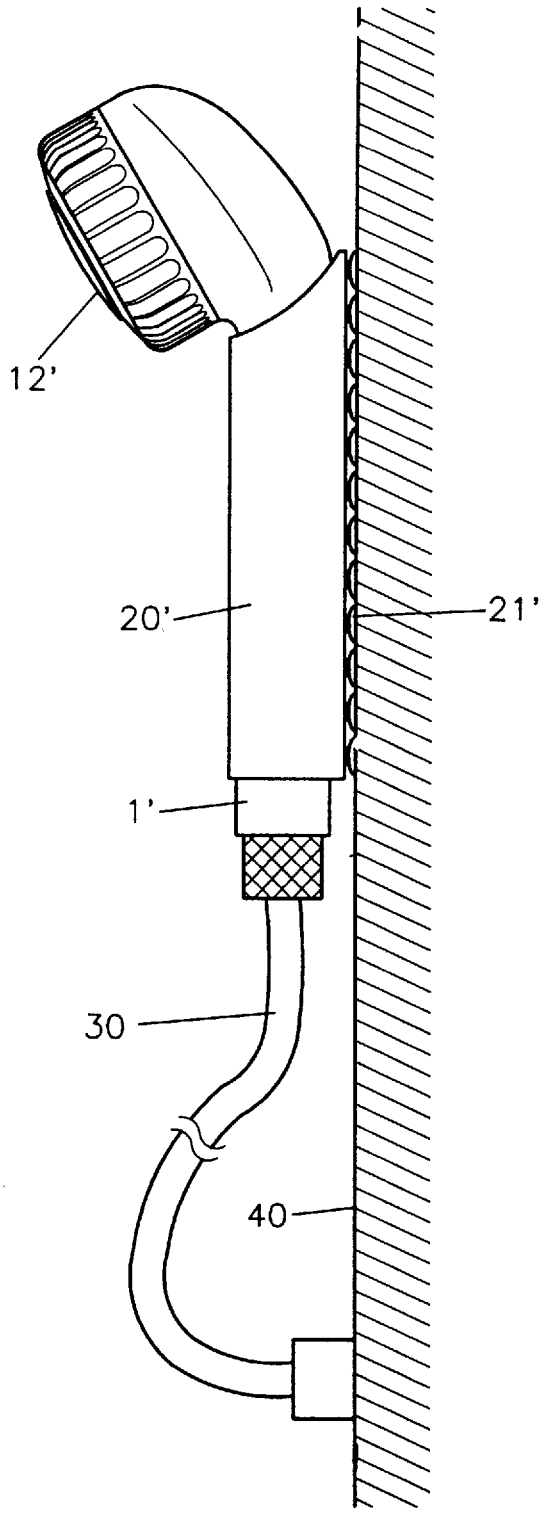
FIG. 7 is a schematic view illustrating a shower head device of a second preferred embodiment disposed on a tile of a wall of a bathroom.

Referring to FIG. 7, the threaded portion 11' of the main body 1' is connected to a water pipe 30. The sucking discs 21' are pressed against a tile 40 of a wall of a bathroom.

This invention has the following advantages.

The shower head device of this invention can be disposed on any position of the wall of the bathroom stably.

The shower head device of this invention can be disposed on the wall of the bathroom without any fixture. Therefore, the user need not watch the position of the fixture while washing the head.

The user need not drill any hole on the wall of the bathroom.

Since the sucking discs are made of soft materials, the sucking discs can be adsorbed on the tile of the wall of the bathroom stably.

Since the sucking discs are made of soft materials, the user can hold the sucking discs stably without slipping.

I claim:

1. A shower head device comprising:

a main body, a threaded portion disposed on a lower end of said main body, a shower face disposed on an upper end of said main body, a lateral recess formed on a lateral of said main body, a flat plate adhered on said lateral recess, and a plurality of sucking discs disposed on said flat plate.

* * * * *